United States Patent [19]

Draghetti et al.

[11] Patent Number: 5,024,043

[45] Date of Patent: Jun. 18, 1991

[54] MACHINE FOR WRAPPING SUBSTANTIALLY PARALLELEPIPED COMMODITIES

[75] Inventors: Fiorenzo Draghetti, Medicina; Antonio Gamberini, Bologna, both of Italy

[73] Assignee: G.D. Societa Per Azioni, Bologna, Italy

[21] Appl. No.: 519,457

[22] Filed: May 7, 1990

[30] Foreign Application Priority Data

May 9, 1989 [IT] Italy ..... 3456 A/89

[51] Int. Cl.[5] ..... B65B 11/32

[52] U.S. Cl. ..... 53/234; 53/225

[58] Field of Search ..... 53/148, 225, 234; 198/471.1

[56] References Cited

U.S. PATENT DOCUMENTS

| | | | |
|---|---|---|---|
| 990,532 | 4/1911 | Fischer | 53/234 X |
| 2,672,717 | 3/1954 | Russell | 53/234 X |
| 3,439,473 | 4/1969 | Focke | 53/234 |
| 3,537,232 | 11/1970 | Mateyka | 53/234 |
| 3,818,675 | 6/1974 | Griner | 53/234 X |
| 4,183,191 | 1/1980 | Focke | 53/225 |
| 4,408,435 | 10/1983 | Sutton | 53/225 |
| 4,559,757 | 12/1985 | Focke | 53/234 X |
| 4,790,115 | 12/1988 | Focke | 53/234 |

FOREIGN PATENT DOCUMENTS

| | | |
|---|---|---|
| 666013 | 2/1952 | United Kingdom . |
| 740548 | 11/1955 | United Kingdom . |
| 1312820 | 4/1973 | United Kingdom . |
| 1552070 | 7/1976 | United Kingdom . |
| 1590311 | 5/1981 | United Kingdom . |

*Primary Examiner*—John Sipos

*Attorney, Agent, or Firm*—Cushman, Darby & Cushman

[57] ABSTRACT

The machine comprises an indexing wheel with radial pockets each designed to accommodate one pack together with a wrapper which, on entering the pocket, is folded to the point where the pack becomes completely enveloped save for an area of each end face lying at right angles to the axis of the wheel; pneumatically or mechanically operated pads are used to clamp the uncovered areas of the ends during indexed rotation of the wheel, thus disallowing movement of the pack internally of the pocket and preventing any relative movement between pack and wrapper.

7 Claims, 3 Drawing Sheets

07/519457
FIG. 3
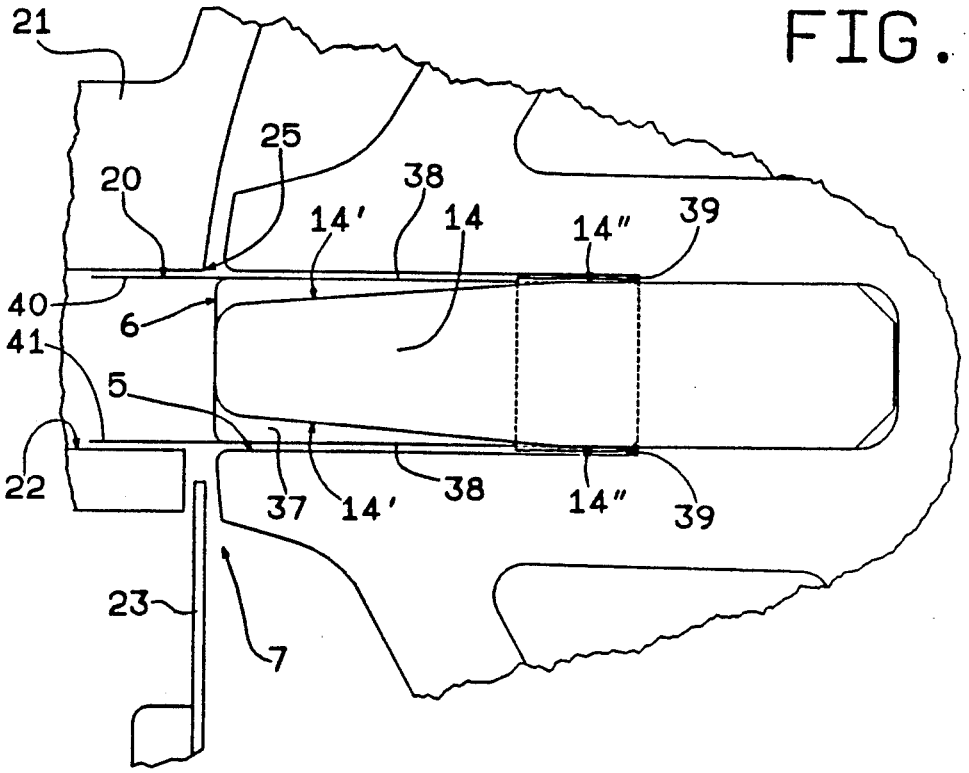
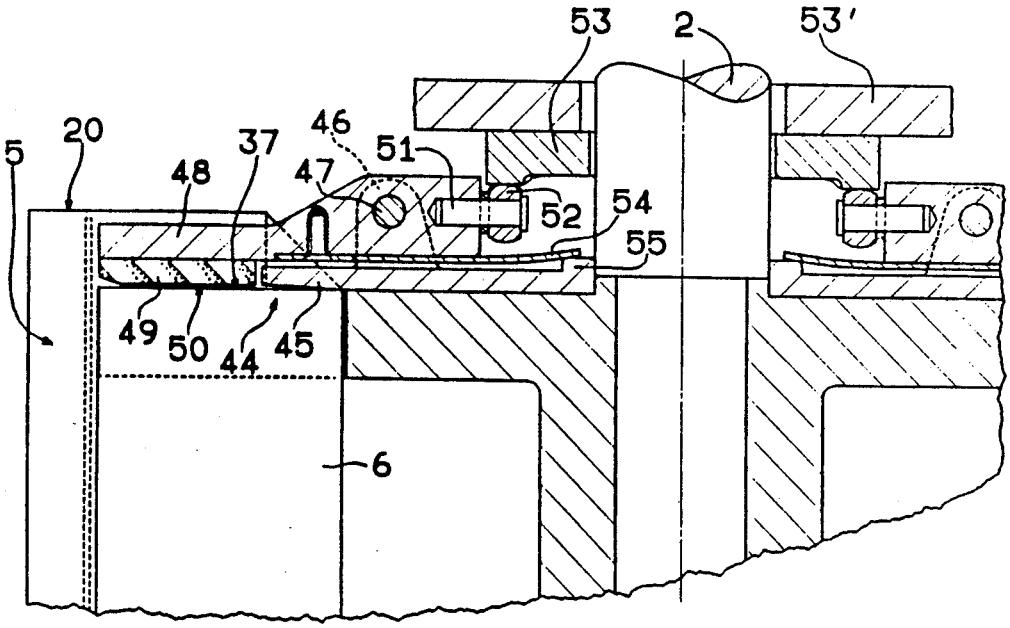
FIG. 4

MACHINE FOR WRAPPING SUBSTANTIALLY PARALLELEPIPED COMMODITIES

BACKGROUND OF THE INVENTION

The invention relates to a machine for wrapping commodities of substantially parallelepiped shape, and in particular, a machine serving to envelop such parallelepiped items in an outer wrapping of transparent material.

The prior art embraces machines for placing an outer wrapping around parallelepiped commodities, especially packs of cigarettes (the case to which the following specification refers); such machines comprise a head, or wheel, rotatable intermittently about a horizontal axis and affording peripheral radial pockets spaced apart one from the next at identical angular distances, each of which designed to accommodate one pack.

The single pocket comprises a bottom wall, nearest the center of the wheel, two substantially radial walls set apart one from the other at a distance essentially matching that of the thickness of one pack, and two end walls embodied generally as two blades lying in planes normal to the axis of the wheel, one on either side, separated by a distance corresponding substantially to the longitudinal dimension of the finished pack.

During each pause produced by intermittent rotation of the wheel, one of the pockets comes to rest at an entry station, in alignment with a reciprocating push rod; stroking forward, the rod engages one pack of cigarettes from the rear flank (considered in relation to the path of entry) and directs it into the waiting pocket together with the wrapper, which consists in a single sheet of material fed through a vertical plane transversely to the path of the entering pack.

On completion of the push rod stroke, the pack will be fully inserted in the pocket with its leading flank flush against the bottom wall.

During the course of this operation, the wrapper is folded gradually into a U shape around the pack, enveloping it on three sides.

The transverse dimension of the wrapper, as seen in relation to the direction of entry, is such that its two sides project a given distance beyond the longitudinal dimension of the pack.

On insertion of the pack into the pocket, these projections will be engaged by the leading edges of the blades aforementioned, and folded in part to envelop a proportion of the two faces of the pack normal to the wheel, i.e. the end faces.

Likewise, the longitudinal dimension of the wrapper is such that, when folded into the 'U' formation, the relative ends project beyond the peripheral limit established by the two radial walls of the pocket.

These two projecting ends, or flaps, are folded subsequently, the one by a moving element made to stroke across the entry point, and the other by a fixed element forming part of a cowling coaxial with the wheel, which engages the relative part of the wrapper as the wheel is set in rotation. With the two radial flaps folded and overlapping, and the wrapper enveloping the pack essentially in tubular fashion, the flank of the pack outermost is offered to a heat-seal device located at a further station subsequently to be occupied by the indexing pocket, and the flaps are fused together.

With the pack enveloped thus far by the transparent wrapper and entirely encompassed by the wheel and cowling with the exception of its top and bottom ends, the pocket is indexed ultimately to an exit station diametrically opposed to the entry station, where a further reciprocating push rod proceeds to eject the pack from the wheel, directing it forward into a runout channel along which the operations of folding and sealing the ends of the wrapper will be brought to completion.

It has been found that, when operating speeds are stretched beyond certain limits, wrapping machines of the type in question begin to betray drawbacks that lead to a decided deterioration in quality of the wrapping.

Beyond such operating speed limits, in effect, the centrifugal force and acceleration produced by the indexing movement of the wheel can cause the pack to shift uncontrollably within the relative pocket, resulting in loss of the correct position of the wrapping as it folds around the pack.

It has been observed in particular, that with the pack thrusting against the two overlapping radial flaps folded along its outermost flank, the tubular formation of the wrapping is disturbed.

The ultimate consequence of such movement is that wrappings become substandard, especially from the standpoint of appearance, and instead of hugging the pack closely, are spoilt by creases and kinks, and corners that fail to coincide with the corners of the pack.

The object of the present invention is to embody a wrapping machine in which all the defects of prior art machines as described above can be overcome, in short, a machine capable of enveloping commodities faultessly in close-fitting wrappings even at ultra high operating speeds.

SUMMARY OF THE INVENTION

In a machine for wrapping commodities substantially parallelepiped in shape, of the type comprising a rotatable head with radial pockets into which such commodities are singly insertable, each disposed with its two opposite end faces occupying relative planes normal to the axis of rotation of the head, together with a sheet of wrapping material located between the commodity and the pocket, the stated object is realized by the adoption of clamping means, which engage at least one of the opposite end faces of the commodity and are designed to hold the commodity in position within the pocket during transfer of the pocket from an point of entry into the head to a point of exit from the head, in such a way as to disallow movement of the commodity internally of the pocket and prevent any relative movement of the commodity and the wrapper.

BRIEF DESCRIPTION OF THE DRAWINGS

The invention will now be described in detail, by way of example, with the aid of the accompanying drawings, in which:

FIG. 3 is the schematic representation of a detail of FIGS. 1 and 2, illustrated in an alternative embodiment;

FIG. 4 is a detail of an alternative embodiment of the machine of FIGS. 1 and 2, seen in section.

DESCRIPTION OF THE PREFERRED EMBODIMENTS

Figure 1:
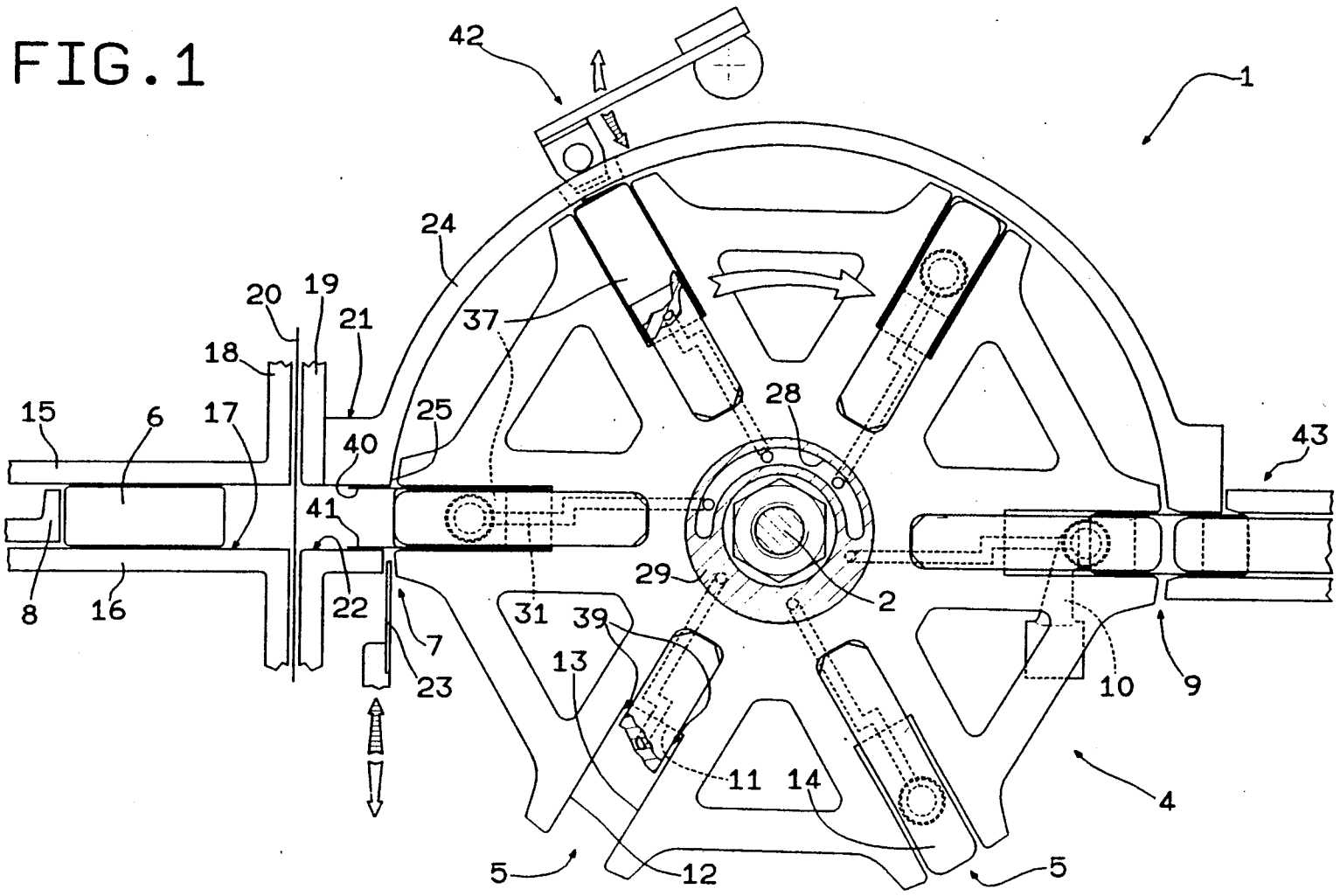
FIG. 1 is the side elevation of a wrapping machine according to the present invention, seen in a first embodiment.
Figure 2:
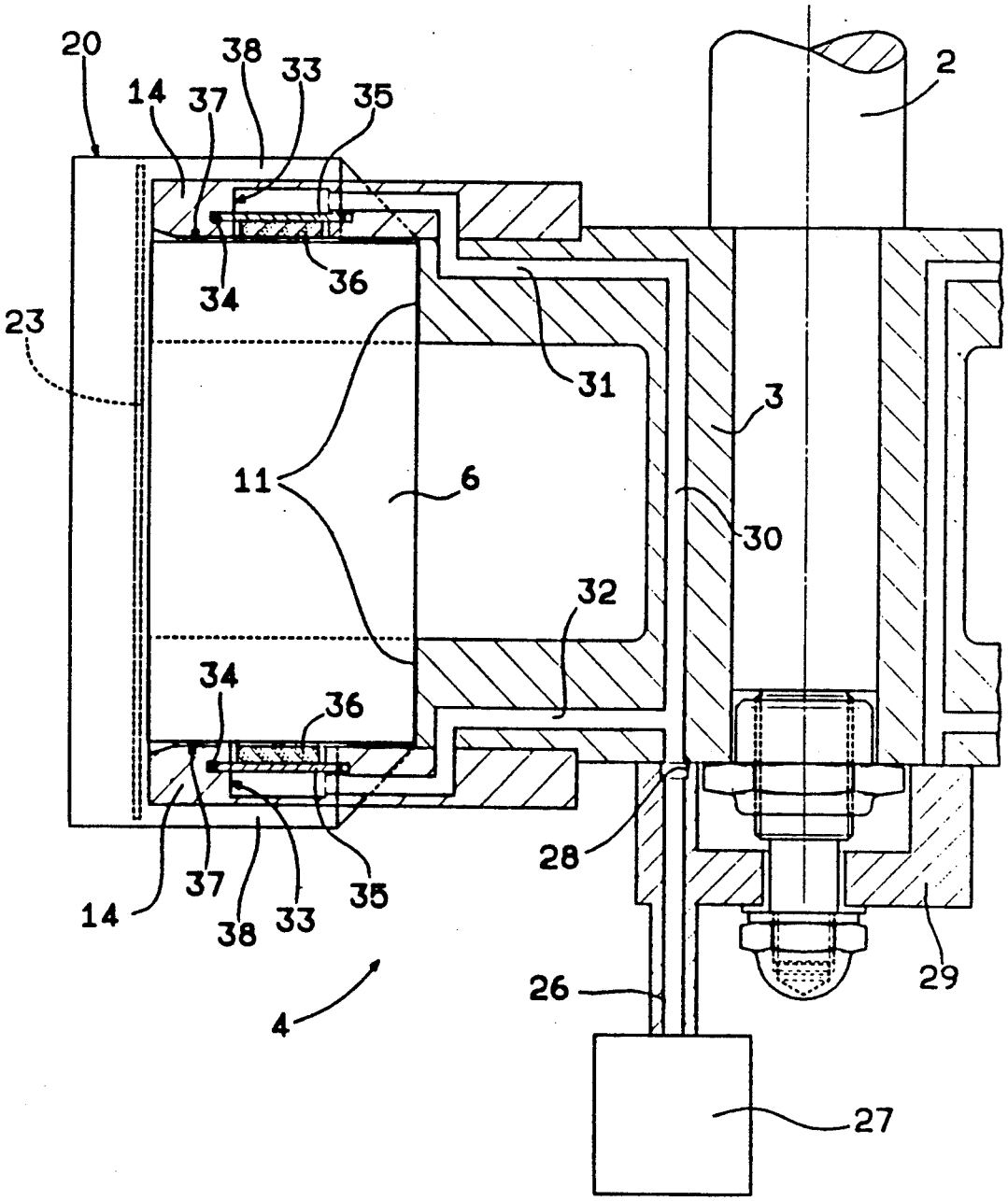
FIG. 2 is a detail of the machine of FIG. 1, seen in section.

With reference to FIG. 1 and FIG. 2 of the drawings, 1 denotes a machine for wrapping commodities of parallelepiped shape, in its entirety, and more particularly, a machine designed to envelop packs of cigarettes in sheets of transparent wrapping material.

The numeral 2 denotes a horizontally disposed shaft affording support by way of a tubular sleeve 3 to a wrapping head, or wheel 4, provided with six peripheral pockets 5 spaced apart at an angle of 60° one from the next, each designed to accommodate one pack 6 positioned sideways-on to the axis of the shaft. The wheel 4 is set in motion by way of the shaft 2 using conventional means (not illustrated) such as will index it through 60° steps in the clockwise direction as viewed in FIG. 1.

The wheel 4 is placed on the shaft 2 in such a way that with each step indexed, one pocket 5 is moved into an entry station 7, positioned in alignment with a reciprocating push rod 8, and the pocket 5 diametrically opposite is moved simultaneously into an exit station 9 positioned in alignment with a further reciprocating push rod 10.

The single pocket 5 is bounded by a bottom wall 11, nearest the center of the wheel 4, and two walls 12 and 13 occupying planes that coincide substantially with radii of the wheel 4 and are separated by a distance substantially equal to the thickness of one pack of cigarettes 6.

Also associated with each pocket 5 are two tongues denoted 14, establishing two further walls disposed normal to the axis of rotation of the wheel 4 and separated by a distance substantially equal to the longitudinal dimension of the pack 6.

The numerals 15 and 16 denote two horizontally disposed guide plates aligned with the push rod 8 of the entry station and affording a passage 17 to the incoming pack 6 of cigarettes.

The numerals 18 and 19 denote two vertical guides, positioned at the exit of the passage 17, between which to feed a continuous strip of transparent material that is severed into single wrappers 20 by a conventional cutting device (not illustrated).

The numeral 21 denotes a fold starter located in the path of the push rod 8 between the vertical guides 18 and 19 and the entry station 7, by which a further passage 22 is afforded to the pack 6.

The numeral 23 denotes a moving folder positioned at the entry station 7, embodied as a vertically disposed vane made to reciprocate through a plane substantially tangential to the wheel 4.

The numeral 24 denotes a cowling, coaxial with the wheel 4 and extending from the entry station 7 to the exit station 9, of which the initial edge 25 serves as a fixed folder, as will become clear in due course.

The numeral 26 denotes a duct of which one end connects with a source of compressed air 27, and the other with valve means embodied as an arched slot 28 formed in a stationary block 29 coaxial with the shaft 2 and breasted with the sleeve 3.

Each of the single pockets 5 is associated with a pneumatic circuit comprising a duct 30 formed in the sleeve 3 and running parallel with the shaft 2; the duct 30 remains directly open to the slot 28, hence to the source of compressed air 27, during passage of the pocket from the entry station 7 to a position coinciding substantially with the exit station 9.

Each duct 30 relative to a single pocket branches into two substantially radial ducts 31 and 32 that are routed through the wheel 4 and along the two tongues 14 and emerge in respective cavities 33 of substantially cylindrical shape, formed internally of the tongues, disposed with axes parallel to the axis of the shaft 2 and with one base directed into the space encompassed by the pocket 5.

The numeral 34 denotes an annular seating afforded by each of the cavities 33 and designed to accommodate a disk element 35 fashioned in flexible material, to which pad means consisting in a circular cushion 36 of resilient material are made fast and positioned with one face adjacent to a corresponding face of the chamber encompassed by the pocket 5.

At each pause of the wheel 4, during operation of the machine, the entry push rod 8 is extended in such a way as to direct a pack 6 of cigarettes and a relative wrapper 20 into the pocket 5 currently positioned at the entry station 7.

Passing through the fold starter 21 and into the pocket 5, the wrapper 20 is folded into a U shape around the pack 6, thereby enveloping the leading flank and the top and bottom faces (considered in relation to the direction of entry).

The transverse dimension of the wrapper 20, as considered in relation to the direction of entry, is such that its sides project a given distance beyond the two longitudinal ends of the pack 6. The parts of the wrapper which project beyond the ends of the leading flank of the pack 6 are folded by the tongues 14 as the pack enters the pocket 5, and more exactly, by the ends 34 of the tongues first encountered on entry, in such a way that the two end faces of the pack diposed normal to the axis of the wheel 4 are enveloped in part. The areas of the two end faces not covered by the wrapper 20 are denoted 37.

The endmost parts of the wrapper extending beyond each end face of the pack 6 thus become a pair of flaps 38 which project from the wheel 4 through respective slits 39 left between the longitudinal edges of each tongue 14 and the pocket wall 12 and 13 on either side.

The longitudinal dimension of the wrapper 20 (as considered in relation to the direction of entry) is such that the ends will project as two radial flaps 40 and 41, respectively top and bottom, from a pocket 5 occupying the entry station 7.

The bottom flap 41 is flattened over the rear flank of the pack 6 by a moving folder 23 installed and operating at the entry station 7. The top flap 40 will be flattened by the initial edge 25 of the cowling 24 once the relative pocket 5 is indexed away from the entry station 7 and into a successive station occupied by a heat seal device 42, which approaches the exposed flank of the pack and fuses the overlapping flaps 40 and 41 together.

The pack 6 accommodated by the pocket 5 appears at this point entirely enveloped by the transparent wrapper 20, with the exclusion of the two areas 37 of the end faces aforementioned; following the heat seal, two further indexed steps bring the pack 6 to the exit station 9, where the relative push rod 10 will eject it from the wheel 4 and into a runout 43 along which the procedure of folding and sealing the end flaps is brought to completion.

For as long as the pack 6 remains in the wheel 4, the two cavities 33 remain connected to the source of compressed air 27 by way of the valve slot 28, causing the disk elements 35 to flex and urge the pads 36 against the areas 37 of the two end faces not enveloped by the wrapper 20.

The pneumatic system comprising the compressed air source 27, the valve means 28 and the various ducts connecting with the cavities 33, together with the pads 36, constitute clamping means by way of which to grip a pack 6 securely in the relative pocket 5; such means are comfortably able to counteract the effects of centrifugal force and acceleration to which each pack becomes subject during its passage from the entry station 7 to the exit station 9. The wrapper 20 likewise, held between the pack 6 and the walls 11, 12 and 13 of the pocket 5, is secured indirectly by the action of the clamping means thus incorporated.

FIG. 3 illustrates an alternative embodiment of the invention, in which the tongues 14 exhibit a shape different to the essentially parallelepiped example of FIGS. 1 and 2.

More exactly, the single tongue 14 might exhibit edge faces or edge sections 14', occupying planes substantially parallel to the axis of rotation and converging toward the periphery of the wheel 4, of which the side radially innermost in relation to the wheel merges with a further edge face or edge section 14" parallel with the radial pocket walls 12 and 13.

In this instance, a wrapper 20 entering the pocket will be held more securely against the pack 6, as the flaps 38 are pinched tight by the two slits 39 created between the innermost sections 14" of the tongues 14 and the relative walls 12 and 13 of the pocket 5.

In a further embodiment of the present invention illustrated in FIG. 4, the tongue 14 of FIGS. 1 . . . 3 is replaced by a tongue assembly denoted 44 in its entirety, constituting the side wall of the pocket, which comprises a fixed plate 45 associated with the sleeve 3 and disposed radially with respect to the shaft 2.

The numeral 46 denotes a lug associated rigidly with the middle part of the plate 45, which is directed away from the pocket and carries a pivot 47 at its projecting end; the tongue proper of the assembly 44 consists in a rocker 48 that occupies a substantially radial position in relation to the shaft 2 and is mounted rotatably to the pivot 47 by way of one end.

49 denotes a pad, fashioned preferably in resilient material and permanently attached to a part of the rocker 48 directed into the space encompassed by the pocket 5, of which one surface 50 is offered to the corresponding end face of a pack 6 occupying the relative pocket 5. The end of the rocker 48 connected to the pivot 47 carries a pin 51 disposed substantially radial to the shaft 2 and fitted with a freely rotatable rolling follower 52 designed to engage a cam profile 53 of disk-like embodiment disposed coaxial with the shaft 2 and associated rigidly with a part of the frame of the wrapping machine 1 denoted 53'.

The rocker 48, follower 52 and cam 53 thus provide actuator means by which to operate the pad 49. 54 denotes a leaf spring 54 attached to the end of the rocker 48 adjacent to the plate 45, its free end tensioned against a heel 55 afforded by the plate 45, by which the follower 52 is maintained permanently in rolling contact with the cam 53.

The pad 49, together with the actuator means comprising the rocker 48, the follower 52 and the cam 53, constitute clamping means by which to hold the pack 6 firmly inside the relative pocket 5. At each pause of the wheel 4, during operation of the machine, the entry push rod 8 is extended in such a way as to direct a pack 6 of cigaretts and a relative wrapper 20 into the pocket 5 currently positioned at the entry station 7, whereupon the pack 6 occupying the pocket 5 is enveloped by the wrapper 20 in the manner already described.

At a moment immediately following the instant in which the wheel begins to rotate, with the pack 6 fully inserted in the pocket 5, the cam 53 causes the corresponding follower 52 to shift, rotating the relative rocker 48 anticlockwise (as viewed in FIG. 4) about its pivot 47 in such a way as to urge the pad 49 against the adjacent end face of the pack 6.

The pad 49 remains pressed thus against the end of the pack 6 until a moment immediately prior to that in which the pack is ejected from the wheel 4 by the push rod 10 at the exit station 9.

Accordingly, the single pack 6 remains securely clamped throughout its occupation of the relative pocket 5 of the wheel 4, and thus undisturbed by the effects of centrifugal force and acceleration attributable to the indexing movements which take it from the entry station 7 to the exit station 9. Likewise the wrapper 20, held between the pack 6 and the pocket walls 11, 12 and 13, is retained in position indirectly by the clamping means of which the pads 49 form a part.

What is claimed:

1. A machine for wrapping substantially parallelepiped commodities, comprising:

a rotatable head with a plurality of radial pockets into respective ones of which respective commodities are singly insertable, each disposed with its two opposite end faces occupying relative planes normal to an axis of rotation of the head, together with a sheet of wrapping material located between a respective said commodity and respective said pocket;

pressing-type clamping means, designed to engage at least one of the opposite end faces of the commodity and hold the commodity in position within the pocket during transfer of the pocket from a point of entry into the head to a point of exit from the head, in such a way as to disallow movement of the commodity internally of the respective pocket and prevent any relative movement of the commodity and the respective sheet of wrapping material;

each said radial pocket being encompassed by a bottom wall, two substantially radial walls and two side walls normal to the axis of rotation of the head, and accommodates a respective commodity enveloped entirely by the sheet of wrapping material save for an area of the two end faces offered to the side walls;

said pressing-type clamping means comprising a source of compressed air, a pneumatic circuit associated with each pocket, valve means by which the circuit is connected to the source during occupation of the pocket by the commodity, and pad means located at one end of the pneumatic circuit associated with each pocket, operating in conjunction with the side walls of the pocket and directed against only said uncovered area of at least one of the opposite end faces of a commodity occupying the pocket.

2. A machine for wrapping substantially parallelepiped commodities, comprising:

a rotatable head with a plurality of radial pockets into respective ones of which respective commodities are singly insertable, each disposed with its two opposite end faces occupying relative planes normal to an axis of rotation of the head, together with a sheet of wrapping material located between a respective said commodity and respective said pocket;

pressing-type clamping means, designed to engage at least one of the opposite end faces of the commodity and hold the commodity in position within the pocket during transfer of the pocket from a point of entry into the head to a point of exit from the head, in such a way as to disallow movement of the commodity internally of the respective pocket and prevent any relative movement of the commodity and the respective sheet of wrapping material;

each said radial pocket being encompassed by a bottom wall, two substantially radial walls and two side walls normal to the axis of rotation of the head, and accommodates a respective commodity enveloped entirely by the sheet of wrapping material save for an area of the two end faces offered to the side walls;

said pressing-type clamping means comprising pad means carried by at least one of the two side walls of each pocket, clamped against only said uncovered area of at least one of the two opposite end faces of a commodity occupying the pocket, and actuator means by which the pad means are caused to operate during occupation of the pocket by the commodity.

3. A wrapping machine as in claim 2, wherein actuator means comprise cam means.

4. A wrapping machine as in claim 1, wherein the two pocket side walls disposed normal to the axis of the head are provided by respective faces of two tongues, occupying substantially radial positions relative to the axis of the head and encompassing the pocket on either side, each of which exhibits two further edge faces comprising respective outer sections that converge toward the periphery of the head, and respective inner sections combining with the substantially radial walls of the pocket to create two slits by which determined folded parts of the sheet of wrapping material are accommodated and positively restrained.

5. A wrapping machine as in claim 4, wherein the outer section of each edge face is connected at the end radially innermost, in relation to the head, with the end of a further section disposed parallel to and combining with the substantially radial wall of the pocket lying adjacent to create a slit by which a determined folded part of the sheet of wrapping material is accommodated and positively restrained.

6. A wrapping machine as in claim 3, wherein the two pocket side walls disposed normal to the axis of the head are provided by respective faces of two tongues, occupying substantially radial positions relative to the axis of the head and encompassing the pocket on either side, each of which exhibits two further edge faces comprising respective outer sections that converge toward the periphery of the head, and respective inner sections combining with the substantially radial walls of the pocket to create two slits by which determined folded parts of the sheet of wrapping material are accommodated and positively restrained.

7. A wrapping machine as in claim 6, wherein the outer section of each edge face is connected at the end radially innermost, in relation to the head, with the end of a further section disposed parallel to and combining with the substantially radial wall of the pocket lying adjacent to create a slit by which a determined folded part of the sheet of wrapping material is accommodated and positively restrained.

* * * * *